US009177706B2

(12) United States Patent
Fukui et al.

(10) Patent No.: US 9,177,706 B2
(45) Date of Patent: Nov. 3, 2015

(54) METHOD OF PRODUCING AN AMORPHOUS TRANSFORMER FOR ELECTRIC POWER SUPPLY

(75) Inventors: Kazuyuki Fukui, Tainai (JP); Koji Yamashita, Tainai (JP); Yuichi Ogawa, Tokyo (JP); Masamu Naoe, Tokyo (JP); Yoshihito Yoshizawa, Tokyo (JP)

(73) Assignee: HITACHI INDUSTRIAL EQUIPMENT SYSTEMS CO., LTD., Tokyo (JP)

( * ) Notice: Subject to any disclaimer, the term of this patent is extended or adjusted under 35 U.S.C. 154(b) by 362 days.

(21) Appl. No.: 13/101,364

(22) Filed: May 5, 2011

(65) Prior Publication Data

US 2011/0203705 A1 Aug. 25, 2011

Related U.S. Application Data

(62) Division of application No. 12/280,810, filed as application No. PCT/JP2007/053581 on Feb. 27, 2007, now abandoned.

(30) Foreign Application Priority Data

Feb. 28, 2006 (JP) ..... 2006-051754

(51) Int. Cl.

| | |
|---|---|
| ***C21D 8/00*** | (2006.01) |
| ***H01F 1/153*** | (2006.01) |
| ***C21D 8/12*** | (2006.01) |

(Continued)

(52) U.S. Cl.

CPC ..... *H01F 1/15308* (2013.01); *C21D 8/1244* (2013.01); *C22C 45/02* (2013.01); *C21D 2201/03* (2013.01); *H01F 41/0226* (2013.01)

(58) Field of Classification Search

CPC ..... C21D 8/00; C21D 6/00
USPC ..... 148/304, 307, 534
See application file for complete search history.

(56) References Cited

U.S. PATENT DOCUMENTS

| | | | |
|---|---|---|---|
| 4,249,969 | A | 2/1981 | DeCristofaro et al. |
| 4,409,041 | A | 10/1983 | Datta et al. |
| 4,763,030 | A | 8/1988 | Clark et al. |

(Continued)

FOREIGN PATENT DOCUMENTS

| | | |
|---|---|---|
| CN | 1520598 | 8/2004 |
| EP | 1 615 240 | 1/2006 |

(Continued)

OTHER PUBLICATIONS

DeMaw, M. F., "Ferromagnetic-Core Design and Application Handbook", Prentice-Hall, Inc., 1981, pp. 2-4.

(Continued)

*Primary Examiner* — Jie Yang
(74) *Attorney, Agent, or Firm* — Baker Botts L.L.P.

(57) ABSTRACT

This method of producing an amorphous transformer for electric power supply comprises forming and shaping an iron core by laminating amorphous alloy thin bands and forming a winding, subjecting the iron core, after forming and shaping, to an annealing treatment in which a temperature of a center portion of the iron core during annealing is 300 to 340° C. and a holding time is not less than 0.5 hr, and applying a magnetic field having a strength of not less than 800 A/m to the iron core while subjecting the iron core, after forming and shaping, to the annealing treatment.

20 Claims, 3 Drawing Sheets

(51) Int. Cl.
*C22C 45/02* (2006.01)
*H01F 41/02* (2006.01)

(56) References Cited

U.S. PATENT DOCUMENTS

| | | | | |
|---|---|---|---|---|
| 5,252,144 | A | 10/1993 | Martis | |
| 7,425,239 | B2 | 9/2008 | Ogawa et al. | |
| 2006/0000524 | A1 * | 1/2006 | Ogawa et al. | 148/304 |
| 2006/0191602 | A1 * | 8/2006 | Hasegawa et al. | 148/304 |
| 2009/0189728 | A1 * | 7/2009 | Fukui et al. | 336/221 |

FOREIGN PATENT DOCUMENTS

| | | | |
|---|---|---|---|
| EP | 1 615 241 | | 1/2006 |
| JP | 58-34162 | | 2/1983 |
| JP | S58-42751 | | 3/1983 |
| JP | H7-122097 | | 2/1988 |
| JP | H04-302114 | | 10/1992 |
| JP | H04-306816 | | 10/1992 |
| JP | 05-114525 | * | 5/1993 |
| JP | H05-114525 | | 5/1993 |
| JP | H05-251252 | | 9/1993 |
| JP | 59-150415 | | 8/1994 |
| JP | 10-323742 | | 12/1998 |
| JP | 2002-285304 | | 10/2002 |
| JP | 2003-338418 | | 11/2003 |
| JP | 2005-39143 | | 2/2005 |
| JP | 2006-045662 | | 2/2006 |
| JP | 2006-241569 | | 9/2006 |
| WO | WO 02/086921 | | 10/2002 |
| WO | WO-2008-136142 | | 11/2008 |

OTHER PUBLICATIONS

U.S. Office Action mailed Jun. 9, 2011, in connection with U.S. Appl. No. 12/280,810, filed Nov. 13, 2008, 14 pages, U.S. Patent and Trademark Office, United States.
Chinese Office Action dated Jul. 20, 2010.
EP Office Action of Appln. 07 71 4974 dated Jan. 27, 2010 in English.
Official Action dated Jan. 29, 2010, Patent Application No. 2006-051754, 3 pages, Japan Patent Office, Japan.
Decision of Patent Grant dated Jul. 20, 2010, Patent Application No. 2006-051754, 3 pages, Japan Patent Office, Japan.

* cited by examiner

| | A | B | C | D | E |
|---|---|---|---|---|---|
| ANNEALING TEMPERATURE [°C] | 320 | 320 | 320 | 330 | 310 |
| ANNEALING TIME [min] | 60 | 60 | 150 | 60 | 120 |
| MAGNETIC FIELD STRENGTH [A/m] | 800 | 2500 | 800 | 800 | 800 |

METHOD OF PRODUCING AN AMORPHOUS TRANSFORMER FOR ELECTRIC POWER SUPPLY

This is a Divisional Application of U.S. application Ser. No. 12/280,810, filed Aug. 27, 2008, which is a national stage application of international application No. PCT/JP2007/053581, filed Feb. 27, 2007 and claims priority from Japanese application serial No. 2006-051754, filed on Feb. 28, 2006, the contents each of which are hereby incorporated by reference into this application.

TECHNICAL FIELD

The present invention relates to a transformer containing an iron core composed of an amorphous alloy thin band and a winding, and particularly to an amorphous transformer for electric power supply characterized by the material of the iron core and the annealing treatment of the iron core.

BACKGROUND ART

Conventionally, an amorphous transformer using an amorphous alloy as the material of the iron core is known. In this amorphous transformer, amorphous alloy foil bands are laminated and bent in a U-shape, and both ends of the amorphous alloy foil bands are butted or overlapped to provide a wound iron core, and the iron loss can be smaller than that of transformers using conventional electromagnetic steel sheets.

However, in the wound iron core structure, stress to worsen the magnetic properties occurs when the material is bent. Therefore, it is necessary to subject the iron core to annealing treatment in a magnetic field to release the stress in order to improve the above magnetic properties. By performing annealing treatment, recrystallization starts inside the material to lead to embrittlement. This applies not only to amorphous alloys but also to electromagnetic steel sheets. At this time, the annealing conditions have a connection with the composition of the alloy, and for Metglas® 2605SA1 of a conventional material, annealing is performed at a temperature of more than 330° C. for 30 minutes or more. Also, in Patent Document 1, the annealing conditions are decided using an original formula.

Patent Document 1: JP-A-58-34162

DISCLOSURE OF THE INVENTION

Problem to be solved by the Invention

An amorphous alloy having a composition different from that of conventional common materials wherein the amorphous ally can provide a high saturation magnetic flux density and a lower loss has been developed by one of the applicants of this application, and this invention has been filed as the patent application (Japanese Patent Application No. 2005-62187). In the patent application for this new material, the composition is mainly described, and detail annealing conditions are not described. However, the composition of the new material is different from that of the conventional common materials. In the circumstances, there is a possibility that the annealing treatment of the above amorphous alloy is different from conventional annealing treatments.

Therefore, it is an object of the present invention to select the optimal annealing conditions for the new material and provide an amorphous transformer for electric power supply having lower loss than transformers using conventional amorphous alloys.

Means for Solving the Problem

The present invention is an amorphous transformer for electric power supply containing an iron core composed of an amorphous alloy thin band and a winding, wherein the iron core has been subjected to annealing treatment in which the temperature of the center portion of the iron core during annealing after the iron core is formed and shaped is 300 to 340° C. and the holding time is 0.5 hr or more.

Also, in the amorphous transformer for electric power supply, the magnetic field strength of the iron core of the present invention during annealing after the iron core is formed and shaped is 800 A/m or more.

Further, the amorphous alloy thin band of the present invention preferably contains an amorphous alloy composed of an alloy composition expressed by $Fe_aSi_bB_cC_d$ (Fe: iron, Si: silicon, B: boron, and C: carbon) in which $80 \le a \le 83\%$, $0 < b \le 5\%$, $12 \le c \le 18\%$, and $0.01 \le d \le 3\%$ in atomic % and an unavoidable impurity. The amorphous alloy thin band having this composition has a high Bs (i.e. saturation magnetic flux density) and an excellent squareness property, so that even if the annealing temperature is low, a magnetic core having properties superior to those of conventional materials can be provided. An amorphous alloy thin band, in which when the concentration distribution of C is measured from the free surface and roll surface of the amorphous alloy thin band to the inside, the peak value of the concentration distribution of C is at a depth in the range of 2 to 20 nm, is preferable as the amorphous alloy thin band for the amorphous transformer for electric power supply.

The reasons for limiting the composition will be described below. Hereinafter, the symbol described as expresses atomic %.

If the symbol "a" representing the amount of Fe is less than 80%, saturation magnetic flux density sufficient as the iron core material is not obtained. Also, if "a" is more than 83%, the thermal stability decreases, and therefore a stable amorphous alloy thin band cannot be manufactured. In view of the circumstances, $80 \le a \le 83\%$ is preferable. Further, 50% or less of the amount of Fe may be substituted by one or two of Co and Ni. The substitution amount is preferably 40% or less for Co and 10% or less for Ni to obtain a high saturation magnetic flux density.

Regarding the symbol "b" representing the amount of Si which is an element that contributes to an amorphous forming ability, it is preferably 5% or less to improve a saturation magnetic flux density.

Regarding the symbol "c" representing the amount of B, it most contributes to an amorphous forming ability. If "c" is less than 8%, the thermal stability decreases. Even if "c" is more than 18%, no improvement effect such as an amorphous forming ability is seen. Also, "c" is preferably 12% or more to maintain the thermal stability of the amorphous having a high saturation magnetic flux density.

C is effective for improving squareness and saturation magnetic flux density. However, if symbol "d" representing the amount of C is less than 0.01%, the effect is little. If "d" is more than 3%, the embrittlement occurs, and the thermal stability decreases.

Also, 0.01 to 5% of one or more elements of Cr, Mo, Zr, Hf, and Nb may be included, and 0.50% or less of at least one or more elements from Mn, S, P, Sn, Cu, Al, and Ti may be contained as an unavoidable impurity.

Further, in the amorphous transformer for electric power supply, the symbol "b" representing the amount of Si in atomic % and the symbol "d" representing the amount of C satisfy the relation of $b \leq (0.5 \times a - 36) \times d^{1/3}$ in the amorphous alloy thin band of the present invention.

Also, the present invention is the amorphous transformer for electric power supply wherein a saturation magnetic flux density of the amorphous alloy thin band after annealing is 1.60 T or more.

The present invention is the amorphous transformer for electric power supply wherein the magnetic flux density of the iron core at an external magnetic field of 80 A/m after annealing is 1.55 T or more.

Further, the present invention is the amorphous transformer for electric power supply wherein the magnetic flux density of the iron core after annealing is 1.4 T, and the iron loss $W_{14/50}$ of a toroidal sample of the iron core at a frequency of 50 Hz is 0.28 W/kg or less.

Also, the present invention is the amorphous transformer for electric power supply wherein the fracture strain $\epsilon$ of the iron core after annealing is 0.020 or more.

Advantages of the Invention

According to the present invention, for an amorphous alloy having a composition of FeSiBC (Fe: iron, Si: silicon, B: boron, and C: carbon) different from that of conventional common materials wherein the amorphous alloy has a high saturation magnetic flux density and a lower loss, an amorphous transformer for electric power supply containing a magnetic core with properties superior to those of conventional materials even if the annealing temperature is low can be provided.

BEST MODE FOR CARRYING OUT THE INVENTION

The best mode for carrying out the present invention will be described.

The examples of amorphous transformers for electric power supply according to the present invention will be described using the drawings.

Example 1

Example 1 will be described. An amorphous transformer for electric power supply according to this example contains an iron core, in which amorphous alloy foil bands are laminated and bent in a U-shape and both ends of the amorphous alloy foil bands are butted or overlapped, and a winding.

An amorphous alloy thin band used for the iron core of this example contains an amorphous alloy composed of an alloy composition expressed by $Fe_aSi_bB_cC_d$ (Fe: iron, Si: silicon, B: boron, and C: carbon) in which $80 \leq a \leq 83\%$, $0 < b \leq 5\%$, $12 \leq c \leq 18\%$, and $0.01 \leq d \leq 3\%$ in atomic % and an unavoidable impurity. When the concentration distribution of C is measured from the free surface and roll surface of the amorphous alloy thin band to the inside, the peak value of the concentration distribution of C is at a depth in the range of 2 to 20 nm. Annealing has been performed, with the temperature of the center portion of the iron core during annealing after the iron core is formed and shaped being 320±5° C. and the holding time being 60±10 minutes. The magnetic field strength during annealing after the iron core is formed and shaped is 800 A/m or more.

In the amorphous alloy thin band of this example, "b" representing the amount of Si in atomic % and "d" representing the amount of C preferably satisfy the relation of $b \leq (0.5 \times a - 36) \times d^{1/3}$. As shown in FIG. 4, the amount of C is depended on to some degree, but by decreasing b/d with respect to a constant amount of C, a composition with a high degree of stress relaxation and a high magnetic flux saturation density is provided, which is most suitable as the material of a transformer for electric power. Further, the embrittlement, the surface crystallization, and the decrease in thermal stability, which occur when a high amount of C is added, are suppressed.

The magnetic flux density of the iron core of this example at an external magnetic field of 80 A/m after annealing is 1.55 T or more. Also, the magnetic flux density of the iron core of this example after annealing is 1.4 T, and the iron loss $W_{14/50}$ of a toroidal sample of the iron core of this example at a frequency of 50 Hz is 0.28 W/kg or less. The fracture strain $\epsilon$ of the iron core of this example after annealing is 0.020 or more.

The annealing conditions of the iron core of the amorphous transformer of this example will be described. As the iron core of the example, an amorphous alloy composed of an alloy composition expressed by $Fe_aSi_bB_cC_d$ (Fe: iron, Si: silicon, B: boron, and C: carbon) in which $80 \leq a \leq 83\%$, $0 < b \leq 5\%$, and $12 \leq c \leq 18\%$ in atomic % was used. Also, as a comparative example, an amorphous alloy composed of an alloy composition expressed by $Fe_aSi_bB_cC_d$ (Fe: iron, Si: silicon, B: boron, and C: carbon) in which $76 \leq a \leq 81\%$, $5 < b \leq 12\%$, $8 \leq c \leq 12\%$, and $0.01 \leq d \leq 3\%$ in atomic % and an unavoidable impurity was used.

Annealing treatment was carried out under different conditions. The annealing time was 1 hour. In FIG. 1, the horizontal axis is annealing temperature, and the vertical axis is a holding force (Hc) obtained after the treatment. In FIG. 2, the horizontal axis is annealing temperature, and the vertical axis is a magnetic flux density obtained when the magnetizing force during annealing is 80 A/m, which is referred to as B80. For both of the amorphous alloys used in the iron core of the example and the iron core of the comparative example, the obtained magnetic properties change according to the annealing conditions. For the amorphous alloy of this example, compared with the amorphous alloy of the comparative example, the holding force (Hc) can be lower even if the annealing temperature is low. For the amorphous alloy of the example, an annealing temperature of 300 to 340° C. is preferable, and particularly an annealing temperature in the range of 300 to 330° C. is more preferable. Also, for the amorphous alloy of the example, compared with the amorphous alloy of the comparative example, B80 can be higher, and moreover the good magnetic properties can be obtained even if the annealing temperature is low. For the amorphous alloy of the example, an annealing temperature of 310 to 340° C. is preferable. Therefore, for the amorphous alloy of the example, the annealing temperature is preferably 310 to 330° C. in order that both magnetic properties are good. This annealing temperature is lower than that of the amorphous alloy in the comparative example by about 20 to 30° C. The lowering of the annealing temperature leads to the lowering of the energy consumption used in the annealing treatment, and therefore the amorphous alloy of the example is also excellent in this respect. For the amorphous alloy of the comparative example, good magnetic properties are not obtained at this annealing temperature. Also, the annealing time is preferably 0.5 hour or more. If the annealing time is less than 0.5 hour, the sufficient properties cannot be obtained. Also, if the annealing time is more than 150 minutes, the properties according to the consumed energy cannot be obtained. Particularly, the annealing time is preferably 40 to 100 minutes and more preferably 50 to 70 minutes.

FIG. 3 shows the property (iron loss) of the transformer containing the iron core of the amorphous alloy of the example, which is the results of the various annealing conditions according to five patterns A to E. Here, patterns C and D are examples using the same material as that of the above comparative example or a material close to that of the above comparative example, and the iron loss of both patterns is worse than that of patterns A and B, which can be said to be the same as the tendency confirmed in FIG. 1. Patterns A and B are examples in which the applied magnetic field strength during annealing is changed for comparison. It is found that the iron loss is almost unchanged even when a magnetic field strength of 800 A/m or more is applied. However, it is necessary to flow much current in pattern B, and therefore the optimum annealing conditions are pattern A. Also, it has been found that the iron loss increases at an applied magnetic field strength of less than 800 A/m. Also, it has been found that although the iron loss in pattern E is slightly inferior to that in pattern A, that pattern E is suitable as the annealing conditions.

Example 2

Next, Example 2 will be described. The amorphous transformer of this Example 2 differs from Example 1 in the material of the amorphous alloy thin band. The amorphous alloy thin band of Example 2 contains an amorphous alloy composed of an alloy composition expressed by $Fe_aSi_bB_cC_d$ (Fe: iron, Si: silicon, B: boron, and C: carbon) in which $80 \le a \le 83\%$, $0 < b \le 5\%$, $12 \le c \le 18\%$, and $0.01 \le d \le 3\%$ in atomic % and an unavoidable impurity. The saturation magnetic flux density of the amorphous alloy thin band of Example 2 after annealing is 1.60 T or more. Numerical values other than these are similar to those of Example 1. The magnetic properties and the like corresponding to annealing conditions were also substantially similar to those of Example 1.

Figure 1:
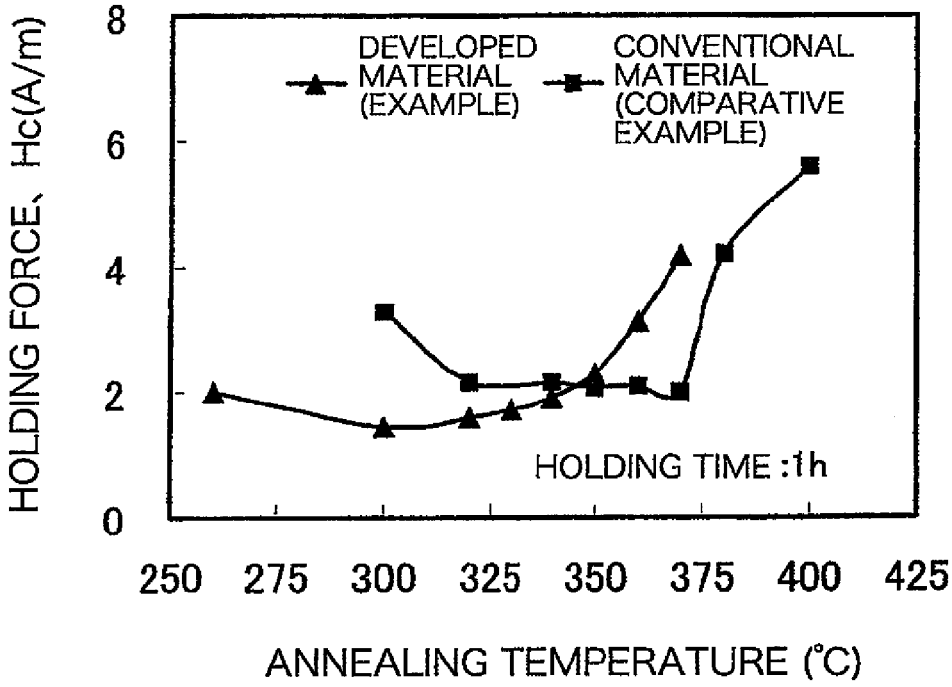
FIG. 1 is an explanatory drawing of the annealing conditions and magnetic property 1 of the developed material of Example 1.
Figure 2:
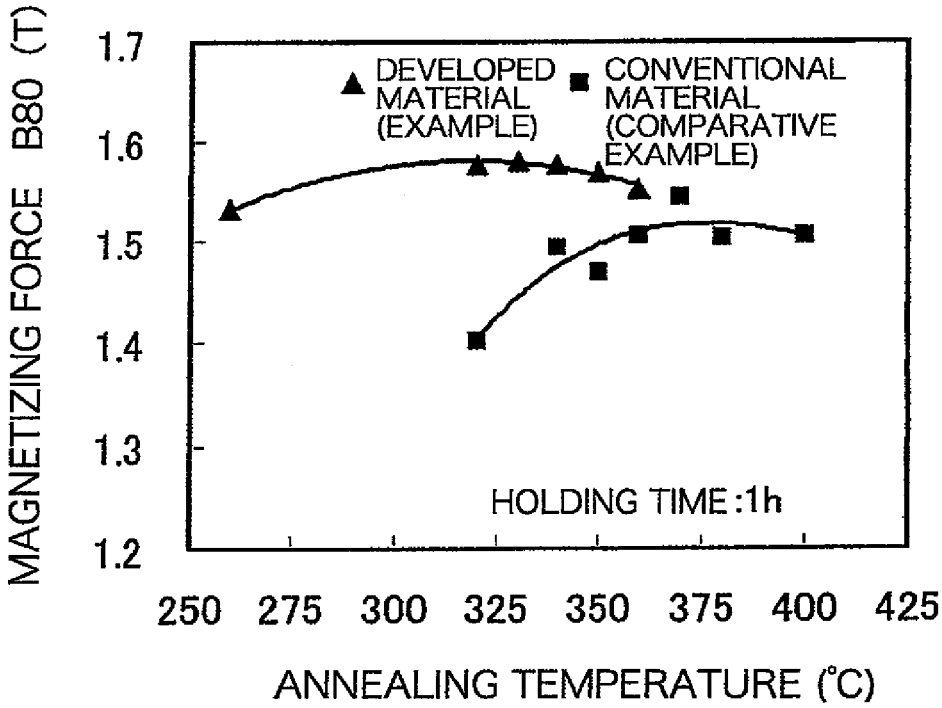
FIG. 2 is an explanatory drawing of the annealing conditions and magnetic property 2 of the developed material of Example 1.
Figure 3:
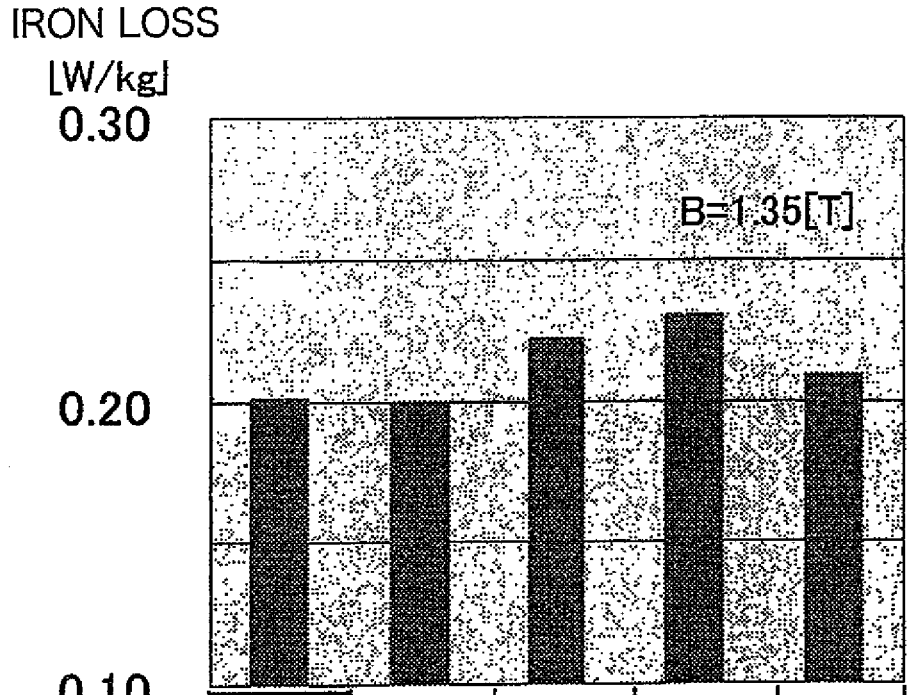
FIG. 3 is an explanatory drawing of the annealing conditions and magnetic property of the amorphous transformer containing the iron core of the developed material of Example 1.
Figure 4:
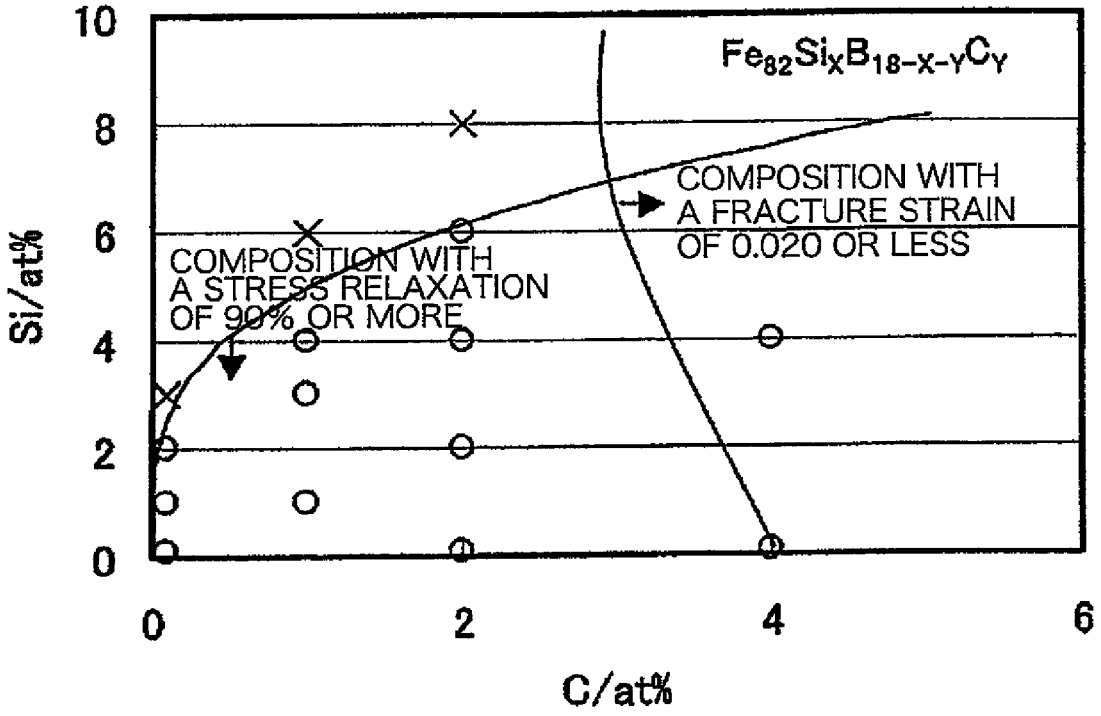
FIG. 4 is an explanatory drawing showing the relationship between b representing the amount of Si and d representing the amount of C, and the relationship between them and the degree of stress relaxation and fracture strain.

The invention claimed is:

1. A method of producing an amorphous transformer for electric power supply, comprising:

forming and shaping an iron core by laminating amorphous alloy thin bands such that the iron core comprises a lamination of the amorphous alloy thin bands and forming a winding, wherein each of the amorphous alloy thin bands comprises an amorphous alloy comprising an alloy composition expressed by $Fe_aSi_bB_cC_d$, wherein Fe is iron, Si is silicon, B is boron, and C is carbon, in which $80 \le a \le 83\%$, $0 < b \le 5\%$, $12 \le c \le 18\%$, and $0.01 \le d \le 3\%$ in atomic % and an unavoidable impurity, subjecting the iron core, after forming and shaping, to an annealing treatment in which a temperature of a center portion of the iron core during annealing is 310 to 320° C. and a holding time is 30 to 150 min, applying a magnetic field having a strength of 800 A/m to the iron core while subjecting the iron core, after forming and shaping, to the annealing treatment, and wherein a fracture strain $\epsilon$ of the iron core is 0.020 or more after subjecting the iron core to the annealing treatment.

2. The method of producing an amorphous transformer for electric power supply according to claim 1, wherein forming and shaping the iron core comprises laminating the amorphous alloy thin bands, bending the amorphous alloy thin bands in a U-shape, and butting or overlapping both ends of the amorphous alloy thin bands to provide a wound iron core.

3. The method of producing an amorphous transformer for electric power supply according to claim 2, wherein a saturation magnetic flux density of an amorphous alloy thin band of the amorphous alloy thin bands is 1.60 T or more after subjecting the iron core, after forming and shaping, to the annealing treatment.

4. The method of producing an amorphous transformer for electric power supply according to claim 1, wherein a saturation magnetic flux density of an amorphous alloy thin band of the amorphous alloy thin bands is 1.60 T or more after subjecting the iron core, after forming and shaping, to the annealing treatment.

5. The method of producing an amorphous transformer for electric power supply according to claim 1, wherein when a concentration distribution of C is measured from a free surface and roll surface of an amorphous alloy thin band of the amorphous alloy thin bands to inside, a peak value of the concentration distribution of C is at a depth in a range of 2 to 20 nm.

6. The method of producing an amorphous transformer for electric power supply according to claim 1, wherein a magnetic flux density of the iron core at an external magnetic field of 80 A/m is 1.55 T or more after subjecting the iron core to the annealing treatment.

7. The method of producing an amorphous transformer for electric power supply according to claim 1, wherein a magnetic flux density of the iron core is 1.4 T, and an iron loss $W_{14/50}$ of a toroidal sample of the iron core at a frequency of 50 Hz is 0.28 W/kg or less, after subjecting the iron core to the annealing treatment.

8. The method of producing an amorphous transformer for electric power supply according to claim 1, wherein the temperature of the center portion of the iron core is 320° C. while subjecting the iron core, after forming and shaping, to the annealing treatment.

9. The method of producing an amorphous transformer for electric power supply according to claim 1, wherein the holding time for subjecting the iron core to the annealing treatment is 60 minutes.

10. The method of producing an amorphous transformer for electric power supply according to claim 1, wherein the temperature of the center portion of the iron core is 320° C., the holding time is 60 minutes, and the magnetic field applied to the iron core is 800 A/m, while subjecting the iron core, after forming and shaping, to the annealing treatment.

11. The method of producing an amorphous transformer for electric power supply according to claim 1, wherein the alloy composition further comprises 0.01 to 5 atomic % of the element Cr.

12. The method of producing an amorphous transformer for electric power supply according to claim 1, wherein the alloy composition further comprises 0.01 to 5 atomic % of the element Mo.

13. The method of producing an amorphous transformer for electric power supply according to claim 1, wherein the alloy composition further comprises 0.01 to 5 atomic % of the element Zr.

14. The method of producing an amorphous transformer for electric power supply according to claim 1, wherein the alloy composition further comprises 0.01 to 5 atomic % of the element Hf.

15. The method of producing an amorphous transformer for electric power supply according to claim 1, wherein the alloy composition further comprises 0.01 to 5 atomic % of the element Nb.

16. The method of producing an amorphous transformer for electric power supply according to claim 1, wherein the alloy composition further comprises 0.01 to 5 atomic % of one or more elements of Cr, Mo, Zr, Hf, and Nb.

17. The method of producing an amorphous transformer for electric power supply according to claim 1, wherein the holding time for subjecting the iron core to the annealing treatment is 50 to 70 minutes.

18. The method of producing an amorphous transformer for electric power supply according to claim 1, wherein $b \leq (0.5 \times a - 36) \times d^{1/3}$.

19. A method of producing an amorphous transformer for electric power supply, comprising:

forming and shaping an iron core by laminating amorphous alloy thin bands such that the iron core comprises a lamination of the amorphous alloy thin bands and forming a winding, wherein each of the amorphous alloy thin bands comprises an amorphous alloy comprising an alloy composition expressed by $Fe_aSi_bB_cC_d$, wherein Fe is iron, Si is silicon, B is boron, and C is carbon, in which $80 \leq a \leq 83\%$, $0 < b \leq 5\%$, $12 \leq c \leq 18\%$, and $0.01 \leq d \leq 3\%$ in atomic % and an unavoidable impurity, subjecting the iron core, after forming and shaping, to an annealing treatment in which a temperature of a center portion of the iron core during annealing is 310 to 330° C. and a holding time is 50 to 70 min, applying a magnetic field having a strength of 800 A/m to the iron core while subjecting the iron core, after forming and shaping, to the annealing treatment, and wherein a fracture strain $\epsilon$ of the iron core is 0.020 or more after subjecting the iron core to the annealing treatment.

20. A method of producing an amorphous transformer for electric power supply, comprising:

forming and shaping an iron core by laminating amorphous alloy thin bands such that the iron core comprises a lamination of the amorphous alloy thin bands and forming a winding, wherein each of the amorphous alloy thin bands comprises an amorphous alloy comprising an alloy composition expressed by $Fe_aSi_bB_cC_d$, wherein Fe is iron, Si is silicon, B is boron, and C is carbon, in which $80 \leq a \leq 83\%$, $0 < b \leq 5\%$, $12 \leq c \leq 18\%$, and $0.01 \leq d \leq 3\%$ in atomic % and an unavoidable impurity, subjecting the iron core, after forming and shaping, to an annealing treatment in which a temperature of a center portion of the iron core during annealing is 300 to 320° C. and a holding time is 60 to 150 min, applying a magnetic field having a strength of 800 A/m to the iron core while subjecting the iron core, after forming and shaping, to the annealing treatment, and wherein a fracture strain $\epsilon$ of the iron core is 0.020 or more after subjecting the iron core to the annealing treatment.

* * * * *